US006382598B1

(12) United States Patent
Terakado

(10) Patent No.: US 6,382,598 B1
(45) Date of Patent: May 7, 2002

(54) FUEL FLOW CONTROL DEVICE FOR DIAPHRAGM-TYPE CARBURETOR

(75) Inventor: Hitoshi Terakado, Sendai (JP)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 09/696,487

(22) Filed: Oct. 25, 2000

(30) Foreign Application Priority Data

Nov. 4, 1999 (JP) ..... 11-313848

(51) Int. Cl.[7] ..... F02M 17/04
(52) U.S. Cl. ..... 261/35; 137/505.47; 261/DIG. 68
(58) Field of Search ..... 261/35, 69.1, 69.2, 261/DIG. 68; 251/86, 85, 333; 137/505.46, 505.47

(56) References Cited

U.S. PATENT DOCUMENTS 3,133,129 A * 5/1964 Phillips ..... 261/DIG. 68
3,377,024 A * 4/1968 Nutten et al. ..... 261/DIG. 68
3,404,872 A * 10/1968 Nutten ..... 261/DIG. 68
3,992,490 A * 11/1976 Preston ..... 261/DIG. 68
4,003,968 A * 1/1977 Rickert ..... 261/35
4,563,311 A * 1/1986 Agnew ..... 261/35
5,288,013 A * 2/1994 Gerhardy ..... 251/333 X
5,681,508 A 10/1997 Gerhardy ..... 261/35
6,202,988 B1 * 3/2001 Abe et al. ..... 261/69.2 X
6,217,008 B1 * 4/2001 Abe et al. ..... 261/69.2 X

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

An improved fuel flow control device of a diaphragm-type carburetor having a lever which can be easily coupled to a flow control valve body. The lever has a resilient portion which flexes to permit a cooperating portion of the valve body to pass thereby and into an opening in the lever. After the valve body is received in the opening, the resilient portion returns at least in part to its unflexed position to retain the valve body and prevent its separation from the lever.

9 Claims, 2 Drawing Sheets

FUEL FLOW CONTROL DEVICE FOR DIAPHRAGM-TYPE CARBURETOR

REFERENCE TO RELATED APPLICATIONS

Applicant claims priority of Japanese patent application, Ser. No. 11-313848, filed Nov. 4, 1999.

FIELD OF THE INVENTION

The present invention relates generally to a diaphragm-type carburetor and more particularly to a fuel flow control device for a diaphragm-type carburetor.

BACKGROUND OF THE INVENTION

In a conventional diaphragm-type carburetor, a fuel flow control valve opens and closes in response to the movement of a diaphragm to admit fuel into a fuel chamber and maintain fuel therein under a substantially constant pressure. To accomplish this, a lever is pivotably supported on a shaft within the fuel chamber. One end of the lever is biased and abutted against the diaphragm by means of a spring, and the other end of the lever engages a valve body of the flow control valve. FIG. 5 shows one such lever 55 of a conventional carburetor. The lever has a cut-out 80 at one end thereof to define a pair of left and right arms. The clearance between the arms is larger than the diameter of a circumferential engagement groove 72 (FIG. 2) formed in an outer surface of the valve body of the flow control valve. Undesirably, the lever can become disengaged from the groove 72 when the lever is in an inclined position, particularly, when a subassembly including the lever and the flow control valve body is mounted in the constant pressure fuel chamber of the carburetor.

SUMMARY OF THE INVENTION

An improved fuel flow control device of a diaphragm-type carburetor having a lever which can be easily coupled to a flow control valve body and cannot become disengaged from the flow control valve body in use and has a reliable and repeatable operational movement.

The fuel flow control device embodying the invention has a constant pressure fuel chamber defined in part by a fuel metering diaphragm with a pivotably mounted lever therein actuated by the diaphragm and coupled to a valve body so that it cannot become disengaged in use. One end of the lever is biased and abutted with the diaphragm preferably by a spring. The flow control valve body is operably connected to the other end of the lever for movement relative to a valve seat between open and closed positions to control fluid flow through an inlet passage leading to the constant pressure fuel chamber. The end of the lever coupled to the valve body preferably has a boss and a pair of arms extending perpendicular to the boss. A top plate having an opening is fitted on the lever on or between the pair of arms. The opening of the top plate is adapted to receive the valve body in the area of a circumferential engagement groove formed in the valve body. The top plate has a pair of spaced apart and generally opposed resilient hook pieces with a clearance or gap between them which is smaller then the diameter of the valve body in the area of the engagement groove. The hook pieces are at least somewhat flexible to permit the valve body to pass thereby into the opening in the top plate and are resilient so that they return to their unflexed position after the valve body passes to maintain the valve body in the opening. In this manner, unintended disengagement or separation of the lever and valve body is prevented in use of the carburetor.

In another form, the lever has a circumferentially continuous opening of a smaller diameter than an end portion of the valve body and slightly larger diameter than the valve body in the engagement groove. The lever is somewhat flexible and resilient in the area of the opening and flexes to permit the end portion of the valve body to pass thereby disposing the engagement groove in the opening. Thereafter, the flexed portion of the lever preferably returns sufficiently towards its unflexed orientation to prevent the end portion from passing thereby in use of the valve assembly. This prevents unintended separation of the lever and valve body.

Objects, features and advantages of this invention include providing a fuel flow control device which is easy to assembly, is easy to install in a carburetor, prevents separation of a lever and valve body in use, provides a smooth operation and movement of the valve body, is reliable, durable, of relatively simple design and economical manufacture and assembly and in service has a long useful life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
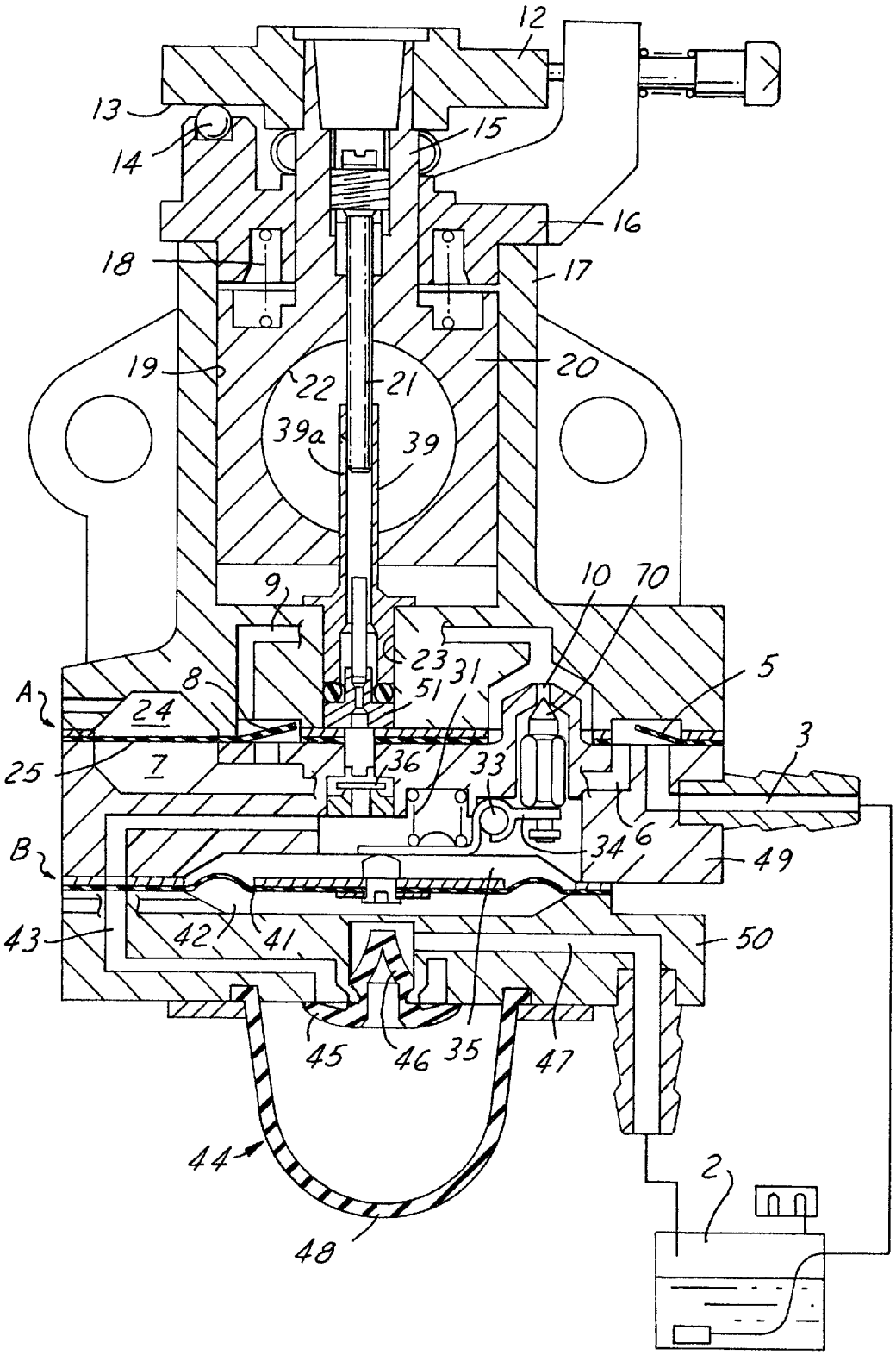
FIG. 1 is a front sectional view showing a carburetor having a diaphragm-actuated fuel control device according to the present invention.

Referring in more detail to the drawings, FIG. 1 illustrates a carburetor 11 having a cylindrical valve chamber 19 which engagedly receives a rotary throttle valve 20 having a throttle opening 22. The throttle valve 20 can rotate around its central axis and is vertically slidably movable in valve chamber 19. The throttle valve 20 has a shaft 15 at a top end thereof and supported on a cover plate 16 which closes the cylindrical valve chamber 19. The shaft 15 is coupled to a throttle lever 12 which has a lower inclined cam surface 13. The cam surface 13 engages with a ball 14 retained on the cover plate 16 by the resilient force of a return spring 18. The shaft 15 holds a rod valve 21 adjustably threaded and screwed into the shaft 15. The rod valve 21 extends into a throttle opening 22 of the rotary throttle valve 20 and is slidably received in a fuel feed pipe 39.

Turning the throttle lever 12 by a remote trigger lever (not shown) rotates the throttle valve 20 and changes the degree or extent to which the throttle opening 22 communicates with an air intake passage (not shown) extending axially through the carburetor body 17. At the same time, the throttle valve 20 moves vertically together with the rod valve 21 due to the engagement of the cam surface 13 with the ball 14, so that the open area of a fuel jet hole 39*a* of the fuel feed pipe 39 is adjusted. The fuel feed pipe is engaged with and is supported by a central cylindrical portion 23 disposed on a bottom of the cylindrical valve chamber 19. The fuel feed pipe 39 communicates with a constant pressure fuel chamber 35 of a constant pressure fuel supply assembly B by way of a fuel jet 51 and a check valve 36.

The constant pressure fuel supply assembly B having the constant pressure chamber 35 is provided with a diaphragm 41 sandwiched between an intermediate plate 49 and a cover 50. The diaphragm partially defines the constant pressure chamber 35 on one side and an atmospheric chamber 42 on its other side. A lever 34 is supposed by a support shaft 33 within the constant pressure chamber 35. The lever 34 is resiliently biased at one end thereof by a spring 31 retained in a pocket of plate 49 and on a protrusion 62 of the lever 34. Meanwhile, the other end of the lever 34 is coupled to a poppet-type flow control valve body 70.

Fuel is supplied from a fuel tank 2 to the constant pressure chamber 35 through a fuel pump A and a metering valve assembly with a fuel flow control valve body 70. The fuel pump A and the constant pressure chamber 35 also communicate with a manual priming pump 44. The priming pump 44 communicates with the chamber 35 by way of a passage 43, an inlet check valve 45 provided at a peripheral flange of a mushroom-shaped valve body, an inner space defined by a transfer pipet or flexible rubber dome 48 of the priming pump 44; and with the fuel tank 2 through an outlet check valve 46 provided around a central axis of the mushroom-shaped valve body, and a passage 47. Before cranking or starting an associated engine, the priming pump 44 is operated by manually pressing and releasing the dome 48 to discharge any air in the constant pressure chamber 35 and fuel pump A into the fuel tank 2. Thereby, fuel in the fuel tank 2 is drawn into the constant pressure chamber 35 through a passage 3, the fuel pump A, and the flow control valve body 70.

The fuel pump A has a diaphragm 25 sandwiched between the carburetor main body 17 and the intermediate plate 49. The diaphragm 25 defines partially a pump chamber 7 and a pressure pulse chamber 24. The pressure pulse chamber 24 communicates with a crankcase chamber of the engine (or with a portion of the air intake passage downstream of the throttle valve) to receive fluctuating pressure pulses of the crankcase chamber which actuate and displace the diaphragm 25. The alternate upward and downward movement of the diaphragm 25 produced by the pressure pulses draws fuel from the fuel tank 2 into the pump chamber 7 through the passage 3, an inlet check valve 5, and a passage 6. The fuel in the pump chamber 7 is discharged into the constant pressure chamber 35 through an outlet check valve 8, a discharge passage 9, an inlet passage 10, and the valve body 70. When the constant pressure fuel chamber 35 is filled with the fuel, the diaphragm 41 moves downward so that the lever 34 moves or lifts the valve body 70 to close the end of the inlet passage 10 and prevent or at least substantially restrict fluid flow into the fuel chamber 35. Thereby, the constant pressure fuel chamber 35 keeps fuel therein under a substantially constant pressure.

Figure 2:
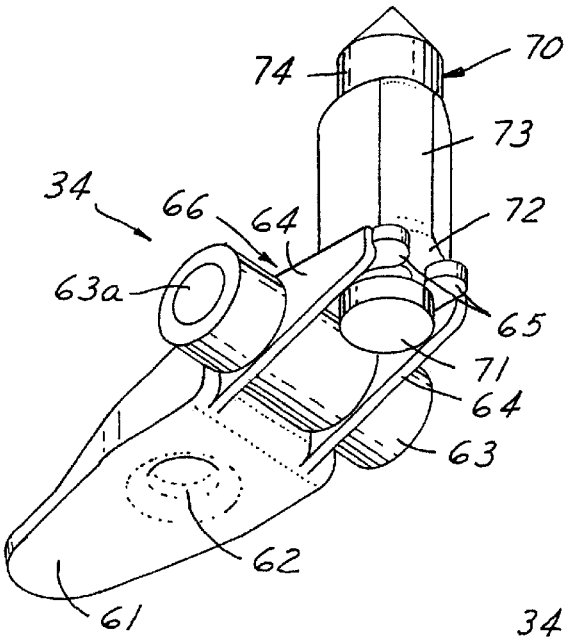
FIG. 2 is a perspective view showing an assembly of a lever and a flow control valve of the fuel control device.

As shown in FIG. 2, the lever 34 has a tube or boss 63 formed with a shaft hole 63*a* for rotatably receiving the aforementioned support shaft 33. Preferably integral with the boss 63, there is provided an arm part 66 consisting of a pair of plate-shaped, left and right arms 64 axially spaced from each other. Each arm 64 has a root portion crossing the boss 63. A lever piece 61 is joined unitarily to the root portions of the arms 64. The lever piece 61 has the protrusion 62 extending from an upper surface thereof which retains one end of the spring 31 to prevent lateral shifting of the spring 31. Between the pair of arms 64, there is provided a top plate 75 which is formed with a semi-circular opening 68 at an inner part of top plate 75. The opening 68 cooperates with and receives a circumferential engagement groove 72 formed in the valve body 70.

Figure 3:
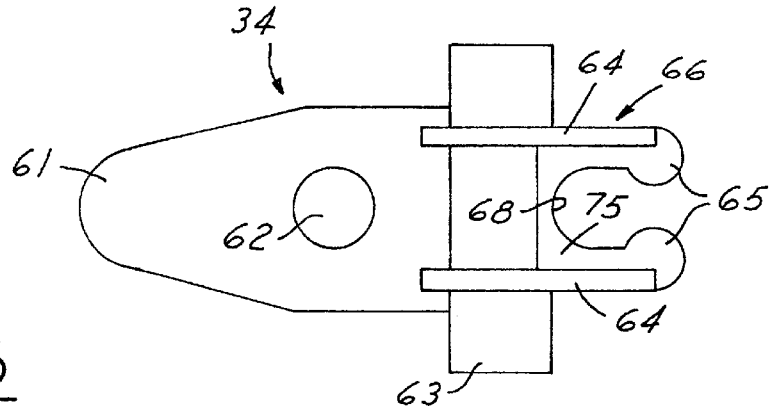
FIG. 3 is a bottom view showing the lever of the fuel control device.

As illustrated in FIG. 3, the opening 68 has a narrowed entrance defined between a pair of left and right resilient hook or detent pieces 65. The resilient hook pieces 65 are preferably each integrally formed with the top plate 75 and are positioned near the outer or free end of each arm 64. The clearance between the resilient hook pieces 65 is smaller than the inner diameter of the opening 68 and also is smaller than the diameter of the valve body 70 in the engagement groove 72.

As best shown in FIG. 2, the valve body 70 has a tapered or conical valve head 74 at one end which engages with and disengages from a valve seat at the inlet passage 10 of the carburetor body 17 for opening and closing and thus controlling fuel flow through the inlet passage 10. The valve body 70 also has a middle sliding portion 73 slidably received in a cylindrical valve hole formed in the intermediate plate 49. The sliding portion 73 is a circular column having flat outer surfaces formed by axially cutting a portion of the peripheral surface of the circular column. At the other end of the valve body 70, there is formed the circumferential engagement groove 72 and an end portion 71 of a short column. The lever 34 and valve body 70 can each be a separate single piece unitarily molded or otherwise formed from a synthetic resin or a metal material.

To connect the valve body 70 to the lever 34, in the area of engagement groove 72 the valve body 70 is forced into the gap between the pair of resilient hook pieces 65 toward the opening 68 to flex the hook pieces outwardly, away from each other, and thereby increase the gap between them. The outwardly flexed hook pieces 65 allow the valve body 70 to enter the opening 68. After the valve body 70 passes the hook pieces 65, the resilient hook pieces 65 return to their original unflexed position to reduce the gap between them and provide the normal clearance which is smaller than the diameter of the valve body 70 in the engagement groove 72. This prevents the disengagement of the lever 34 from the valve body 70 during use of the carburetor and particularly when mounting a subassembly of the valve body 70 and the lever 34 into the carburetor.

In the preferred embodiment as described, the lever 34 has the pair of resilient hook pieces or detents 65 at one end thereof so that each resilient hook piece 65 can flex outwardly to permit the valve body 70 in the area of the engagement groove 72 to pass between them and into the opening 68. The entrance or clearance between the hook pieces 65 when they are unflexed is smaller than the diameter of the opening 68 provided inside of the hook pieces 65 and is smaller than the diameter of valve body 70 in the engagement groove 72. Thus, when the valve body 70 is received in the opening 68 as described, there is no possibility of inadvertent or unintended disengagement from the lever 34. Desirably, an appropriate gap is provided between the engagement groove 72 of the valve body 70 and the lever opening 68 in assembly. This enables a smooth vertical movement of the valve body 70 in response to the pivoting of the lever 34, allowing a reliable operation of the valve body 70.

Figure 4:
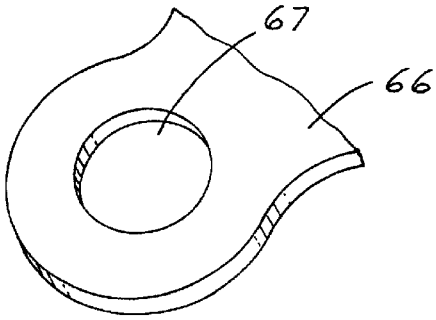
FIG. 4 is a fragmentary perspective view showing a primary part of a lever of a fuel control device according to an alternate embodiment of the present invention.
Figure 5:
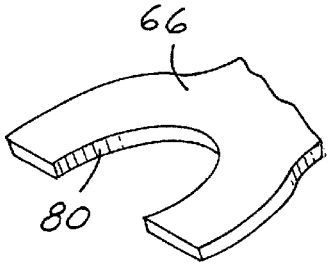
FIG. 5 (PRIOR ART)
FIG. 5 is a fragmentary perspective view showing a primary part of a lever of a conventional diaphragm-actuated fuel control device of a carburetor according to the prior art.

As shown in FIG. 4, a lever 34' according to an alternate embodiment of the invention does not have an entrance clearance as described above but has a completely circular or circumferentially continuous opening 67 slightly smaller than the diameter of the end portion 71 of the valve body 70.

In this embodiment, the end portion 71 of the valve body 70 is forced axially into the opening 67 and resiliently flexes the lever in the area of or at the edge of the opening 67 to permit the end portion 71 to pass through the opening 67 thereby disposing the engagement groove 72 in opening 67. After permitting end portion 71 to pass therethrough, the flexed area or edge of the opening 67 returns at least in part toward its unflexed position so that the opening 67 has a diameter smaller than the diameter of the end portion 71 and larger than the minimum diameter of the engagement groove 72 of the valve body 70 so that the lever is retained in the engagement groove 72. This construction also prevents the disengagement of the received valve body 70 from the lever 34'.

What is claimed is:

1. A fuel flow control device for a carburetor having a diaphragm defining at least in part a constant pressure fuel chamber, said device comprising:

a valve body having a reduced diameter engagement groove and a valve head and being movable between open and closed positions to control fuel flow into the constant pressure fuel chamber; and a lever having opposed ends, pivotably carried by the carburetor between its ends, communicated with the diaphragm at one end to be responsive to movement of the diaphragm and having an opening adjacent to its other end defined at least in part by a resilient portion and having an effective size smaller than a portion of the valve body inserted into the opening with said resilient portion being flexible to permit said portion of the valve body to pass thereby to dispose the engagement groove in the opening and thereafter said resilient portion returns at least in part toward its unflexed state to prevent said portion of the valve body from freely passing thereby to prevent inadvertent separation of the valve body and lever.

2. The device of claim 1 wherein the resilient portion comprises a pair of spaced apart resilient hook pieces having a gap between them when they are not flexed which is smaller than the diameter of the valve body in the engagement groove and can be flexed to permit the valve body in the area of the engagement groove to pass between the hook pieces.

3. The device of claim 1 which also comprises an end portion of the valve body of larger diameter than the engagement groove and wherein the opening is of smaller diameter than the end portion of the valve body and the resilient portion comprises an edge of the opening which flexes to permit the end of the valve body to pass into the opening.

4. The device of claim 3 wherein the opening is circumferentially continuous.

5. The device of claim 2 wherein the lever also comprises a boss with a shaft hole, a pair of arms extending perpendicular to the boss and a top plate disposed on the arms and through which the opening is defined, said hook pieces being carried by the top plate.

6. The device of claim 5 wherein the hook pieces are integral with the top plate.

7. The device of claim 5 wherein the boss, arms and top plate are integrally formed on the lever.

8. The device of claim 5 which also comprises a support shaft disposed in the shaft hole carried by the carburetor and about which the lever pivots.

9. The device of claim 1 wherein the opening is slightly larger than the valve body in the engagement groove to provide a gap between them.

* * * * *